US009677577B1

(12) United States Patent
Khalil

(10) Patent No.: US 9,677,577 B1
(45) Date of Patent: Jun. 13, 2017

(54) DREDGE HAVING MODULAR HYDRAULIC MANIFOLDS

(71) Applicant: Ellicott Dredge Enterprises, LLC, Baltimore, MD (US)

(72) Inventor: Rabie E. Khalil, Baltimore, MD (US)

(73) Assignee: ELLICOTT DREDGE ENTERPRISES, LLC, Baltimore, MD (US)

( * ) Notice: Subject to any disclaimer, the term of this patent is extended or adjusted under 35 U.S.C. 154(b) by 0 days.

(21) Appl. No.: 15/374,772

(22) Filed: Dec. 9, 2016

(51) Int. Cl.
*E02F 3/88* (2006.01)
*F15B 13/08* (2006.01)
*E02F 3/90* (2006.01)

(52) U.S. Cl.
CPC ..... *F15B 13/0814* (2013.01); *E02F 3/885* (2013.01); *E02F 3/90* (2013.01); *F15B 13/085* (2013.01); *F15B 13/086* (2013.01)

(58) Field of Classification Search
CPC .... E01H 1/00; E02F 3/88; E02F 3/885; E02F 5/006; E02F 7/005; E02F 3/90; F15B 11/165; F15B 11/02; F15B 13/0422; F15B 13/0426; F15B 13/043; F15B 13/0402; F15B 13/0438; F15B 21/087; F15B 13/0814; F15B 13/085; F15B 13/086; F16H 61/433
USPC ..... 172/2–11; 37/189, 309, 313, 307, 346; 701/50; 60/327, 443, 452, 422, 428, 465; 91/433, 461, 464
See application file for complete search history.

(56) References Cited

U.S. PATENT DOCUMENTS 3,720,059 A * 3/1973 Schurawski ..... B62D 11/183 60/421
4,379,054 A * 4/1983 Ayers ..... E02B 15/046 210/242.3
4,628,623 A * 12/1986 Deal ..... E02F 3/9237 37/195
6,022,173 A * 2/2000 Saxon ..... E02F 5/08 37/337
6,164,385 A * 12/2000 Buchl ..... A01B 63/1115 172/239
6,929,031 B2 * 8/2005 Ford ..... F16H 61/0009 137/884
7,431,101 B2 * 10/2008 Hacker ..... E01H 1/00 172/2

(Continued)

OTHER PUBLICATIONS

Zollern, "Drive Technology, Free fall Winches", www.zollern.com, pp. 1-12 (Mar. 2016).

(Continued)

*Primary Examiner* — Robert Pezzuto
(74) *Attorney, Agent, or Firm* — Finnegan, Henderson, Farabow, Garrett & Dunner, L.L.P.

(57) ABSTRACT

A hydraulic manifold may be used with a dredge. The hydraulic manifold may have a body with a mounting surface, a front surface located opposite the mounting surface, a top surface located between the mounting and front surfaces, a bottom surface located opposite the top surface, and end surfaces located opposite each other and connecting the mounting, front, top, and bottom surfaces. The manifold may also have at least one drain port and at least one supply port in at least one of the end surfaces, at least one valve port in the top surface, at least one consumer port in the top surface, and at least one transponder port in the bottom surface.

26 Claims, 6 Drawing Sheets

(56) References Cited

U.S. PATENT DOCUMENTS 7,600,825 B2 * 10/2009 Ziegler ..... B60T 13/04 303/3
9,226,440 B2 * 1/2016 Bassett ..... A01B 63/114

OTHER PUBLICATIONS

Zollern, "Rope Winches and Geerboxes", www.zollern.com, pp. 1-20 (Mar. 2016).
Pull Master, "Experience the Power of Pullmaster Planetary Winches" www.team-twg-com, pp. 1-16 (© 2009).
Pull Master, "Instruction and Parts Model Model M12 Freespool Planetary Hydraulic Winch" www.team-twg.com, PMC 256, 1-32 (Effective Oct. 1, 2011).
Lantec, "Strength You Can Depend On", Pull Master, www.team-twg.com, pp. 1-53 (Nov. 14, 2011).

* cited by examiner

DREDGE HAVING MODULAR HYDRAULIC MANIFOLDS

TECHNICAL FIELD

The present disclosure is directed to a dredge, and more particularly, to a dredge having modular hydraulic manifolds.

BACKGROUND

A dredge is a ship, boat, barge or other floating platform equipped with a pump-type excavation system. The excavation system removes material (e.g., debris, aggregate, ore, contaminates, etc.) from a lake, canal, harbor, river, ocean, pond, or stream bed by digging through the material, agitating the material and/or simply drawing suspended material to create a slurry from a mixture of collected material and water, and pumping the slurry through conduits to a desired location onboard the vessel, in the water, or on land. Dredging can be associated with many different industries, including conservation, construction, mining, and transportation.

The excavation system of a dredge is typically powered via a hydraulic system. In particular, one or more engines onboard the dredge generate mechanical power that is used to drive any number of different hydraulic pumps. The pumps supply high-pressure fluid to various actuators (e.g., to hydraulic motors and cylinders) associated with anchor winches, digging motors (e.g., bucket line motors or rotary cutter motors), ladder winches, slurry pumps, and spud winches and/or cylinders located onboard the dredge. The actuators are used to raise and lower a ladder on which the digging motors are mounted, to drive the digging motors, to swing the ladder and digging motors from side-to-side, to adjust pivoting of the dredge, and to pump the slurry mixture.

In a conventional dredging excavation system, each pump draws low-pressure fluid from a tank, pressurizes the fluid, and makes the pressurized fluid available to multiple different actuators for use in moving the actuators. In this arrangement, a speed, force, and/or direction of each actuator can be independently controlled by selectively throttling (i.e., restricting) a flow of the pressurized fluid from the pump into and/or out of each actuator. For example, to move a particular actuator at a higher speed, with a greater force, and/or in a particular direction, the flow of fluid from the pump into the actuator is unrestricted, restricted by only a small amount, or restricted to a first direction. In contrast, to move the same or another actuator at a lower speed, with a lower force, or in an opposing direction, the restriction placed on the flow of fluid is increased, reversed, or otherwise adjusted.

The flow rate of fluid into and out of a particular actuator is controlled by way of one or more valves associated with that actuator. For example, a supply valve and a drain valve may be used to connect either the associated pump or the tank with opposing sides of the actuator and thereby create a pressure imbalance that functions to move the actuator. Conventionally, the different valves for the different actuators of an excavation system are separately mounted at scattered locations onboard the vessel that are near the actuators, near the pumps, near the tank, or simply in an available space. Conduits extend between the tank, the pumps, the valves, and the actuators. The conventional excavation system may be complex, cumbersome, difficult to modify or expand, and expensive.

The dredge and manifolds of the present disclosure address one or more of the needs set forth above and/or other problems of the prior art.

SUMMARY

In accordance with one aspect, the present disclosure is directed to a hydraulic manifold for use with a dredge. The manifold may include a body with a mounting surface, a front surface located opposite the mounting surface, a top surface located between the mounting and front surfaces, a bottom surface located opposite the top surface, and end surfaces located opposite each other and connecting the mounting, front, top, and bottom surfaces. The manifold may also include at least one drain port and at least one supply port in at least one of the end surfaces, at least one valve port in the top surface, at least one consumer port in the top surface, and at least one transponder port in the bottom surface.

According to another aspect, the present disclosure is directed to another hydraulic manifold. This hydraulic manifold may include a body having a mounting surface, a front surface located opposite the mounting surface, a top surface located between the mounting and front surfaces, a bottom surface located opposite the top surface, and end surfaces located opposite each other and connecting the mounting, front, top, and bottom surfaces. The hydraulic manifold may also include a drain port and a plurality of supply ports in each of the end surfaces, a common drain rail extending between the end surfaces and fluidly connected to the drain ports, and first and second common supply rails extending between the end surfaces and fluidly connected to opposing pairs of the plurality of supply ports. The first and second common supply rails may be configured to separately receive fluid from first and second pumps. The hydraulic manifold may additionally include a common pilot rail extending between the end surfaces and fluidly connected to opposing pairs of the plurality of supply ports. The common pilot rail may be configured to separately receive fluid from a pilot pump. The hydraulic manifold may further include a plurality of valve ports in the top surface, a plurality of consumer ports in the top surface, a plurality of transponder ports in the bottom surface, a plurality of pressure pickup ports in the front surface, and a plurality of actuator valves in the plurality of valve ports. The plurality of valves are configured to regulate fluid flows between the first common supply rail, the second common supply rail, the common drain rail, and at least one of a swing winch, a ladder winch, and a spud actuator. The hydraulic manifold may also include at least one electromechanical valve in one of the plurality of valve ports. The at least one electromechanical valve may be configured to fluidly connect the at least one supply port, the at least one drain port, and a fail-safe-brake.

According to yet another aspect, the present disclosure is directed to a dredge. The dredge may include a floating platform, and a ladder pivotally mounted at a base end to a bow of the floating platform. The ladder may have a digging device mounted at a distal end. The dredge may also include a ladder winch configured to raise and lower the ladder, at least one spud slidably connected to a stern of the floating platform, at least one spud actuator configured to raise and lower the at least one spud, at least one swing winch configured to swing the ladder, and a plurality of fail-safe-brakes. Each of the plurality of fail-safe-brakes may be associated with one of the ladder winch, the at least one spud actuator, and the at least one swing winch. The dredge may further include a first supply pump, a second supply pump, and a pilot pump. The dredge may additionally include a ladder manifold mounted to the floating platform and fluidly connected between the first supply pump, the second supply pump, the pilot pump, and the ladder winch; a spud manifold mounted to the floating platform and fluidly connected between the first supply pump, the second supply pump, the pilot pump, and the at least one spud actuator; and a swing manifold mounted to the floating platform and fluidly connected between the first supply pump, the second supply pump, the pilot pump, and the at least one swing winch. Each of the ladder, spud, and swing manifolds may include a body having a mounting surface connected to a wall of the floating platform, a front surface located opposite the mounting surface, a top surface located between the mounting and front surfaces, a bottom surface located opposite the top surface, and end surfaces located opposite each other and connecting the mounting, front, top, and bottom surfaces. Each of the ladder, spud, and swing manifolds may also include a common drain rail extending between the end surfaces, first and second common supply rails extending between the end surfaces, and a common pilot rail extending between the end surfaces. The first and second common supply rails may be configured to separately receive fluid from the first and second supply pumps, while the common pilot rail may be configured to separately receive fluid from the pilot pump. Each of the ladder, spud, and swing manifolds may further include a plurality of consumer ports in the top surface and extending to at least one of the ladder winch, at least one spud actuator, and at least one swing winch. Each of the ladder, spud, and swing manifolds may also include a plurality of actuator valves in the top surface of the body and configured to regulate fluid flows between the first common supply rail, the second common supply rail, the common drain rail, and at least one of the ladder winch, the at least one spud actuator, and the at least one swing winch. Each of the ladder, spud, and swing manifolds may additionally include at least one electromechanical valve in the top surface of the body and configured to fluidly connect at least one of the first and second common supply rails or the common drain rail with each of the plurality of fail-safe-brakes.

DETAILED DESCRIPTION

Figure 1:
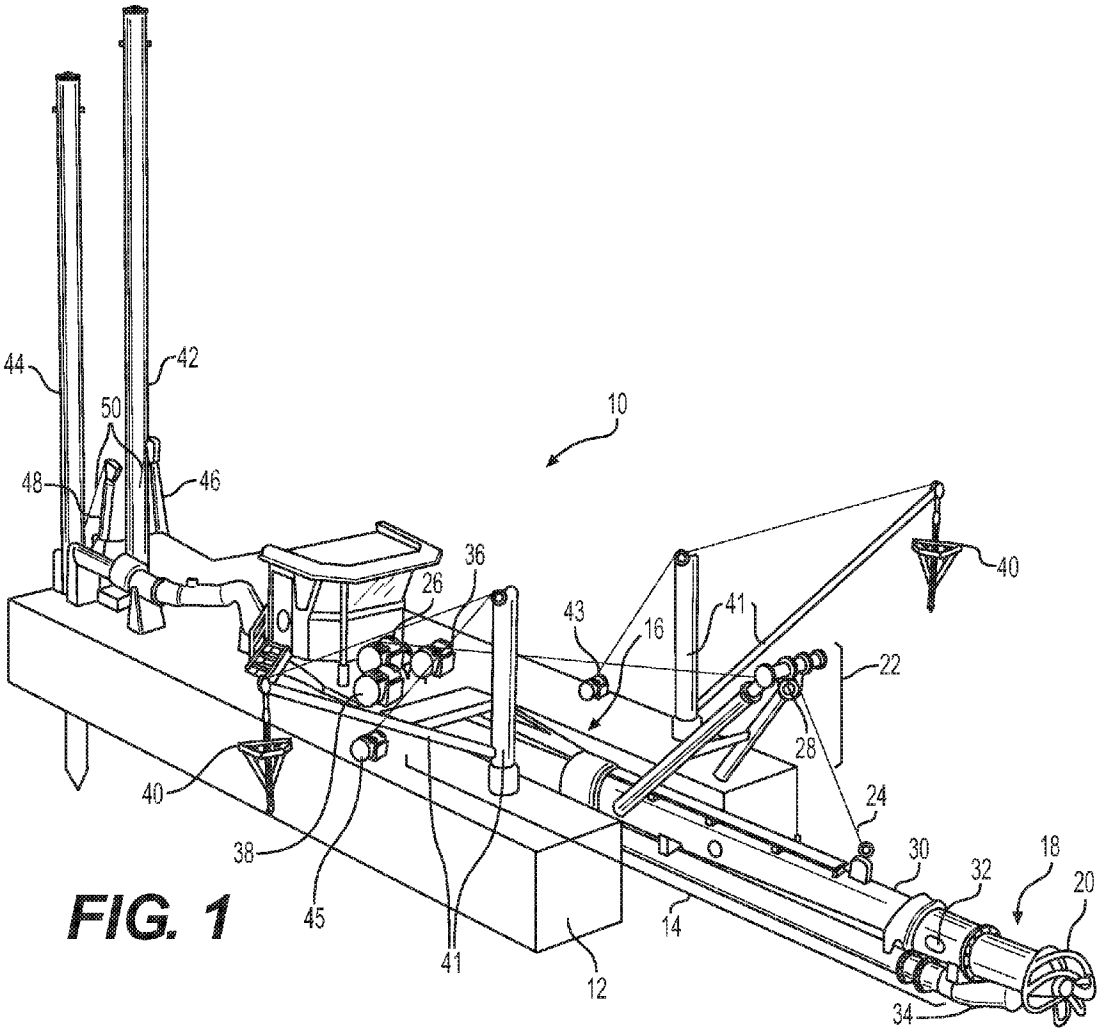
FIG. 1 is an isometric illustration of an exemplary dredge.

FIG. 1 illustrates an exemplary dredge ("vessel") 10. For the purposes of this disclosure, vessel 10 is shown as being a ladder-type of dredge. It should be noted, however, that other types of dredges may also benefit from the disclosed concepts. As a ladder-type of dredge, vessel 10 includes a floating platform 12, on which a ladder 14 is mounted. Ladder 14 may include a base end 16 that is pivotally connected to a deck of platform 12, and a distal end 18 on which a cutter 20 is rotationally supported. A bow gantry 22 may extend forward and upward from the deck of platform 12, at least partially over ladder 14. Bow gantry 22 may be fixedly connected to the deck of platform 12, and one or more cables 24 may extend from a deck-mounted ladder winch 26 over a pulley 28 of bow gantry 22 to ladder 14. In this configuration, hauling in or paying out of cable(s) 24 by ladder winch 26 may result in raising and lowering of ladder 14 and cutter 20. It should be noted that another type of digging device, for example a bucket line (not shown), could be used in place of cutter 20, if desired.

Ladder 14 may include, among other things, a rigid skeletal support 30, an internal driveshaft 32, and a suction pipe 34. Support 30 may be pivotally connected at base end 16 to the deck of platform 12, and protrude forward of vessel 10 to function as framework for the remaining ladder components. Driveshaft 32 may internally extend a length of support 30, from a cutter power source (e.g., from a mechanical transmission or hydraulic motor—not shown, but located inside of platform 12) to cutter 20 to drive the rotation of cutter 20. Suction pipe 34 may be mounted to an underside of support 30 and extend from cutter 20 to a slurry pump (not shown—also located inside of platform 12).

In addition to being raised and lowered, ladder 14 and cutter 20 may additionally swing from side-to-side during digging operations. In particular, port and starboard swing winches 36, 38 may be mounted on opposing sides of platform 12 and used to selectively pull platform 12 toward corresponding anchors 40 that have previously been placed a distance away from platform 12. During pulling of platform 12 toward a particular anchor by one of port or starboard swing winches 36, 38, vessel 10 (together with ladder 14 and cutter 20) may pivot about a stern-located spud.

In some embodiments, anchors 40 may be placed away from platform 12 by a separate vessel (not shown). In other embodiments, however, additional actuators may be used for this purpose. In the depicted example, one or more anchor booms 41 may be used in conjunction with one or more winches (e.g., port and starboard anchor winches 43, 45) to lift, place, and lower anchors 40 at desired positions at a start of a dredging operation.

In the depicted embodiment, vessel 10 is shown as having a port spud 42 and a starboard spud 44 that are spaced apart from each other at the stern of vessel 10. It should be noted, however, that vessel 10 could have a different number of spuds (e.g., a single center-mounted spud) and/or that the spud(s) could be located at the bow or mid-ship, if desired. Each spud of vessel 10 may be selectively raised away from the bed under the water body on which vessel 10 floats, and then selectively dropped back into the bed after repositioning of vessel 10. In this manner, vessel 10 may be "walked" along the bed in a direction of excavation, as winches 36, 38 pull vessel 10 forward. A starboard actuator (e.g., a cylinder or winch) 46 and a port actuator (e.g., a cylinder or winch) 48 may be mounted to platform 12 for this purpose, and operatively connected to the corresponding spud via one or more cables 50. In some embodiments (not shown), a spud carriage may be provided, along with a carriage actuator and/or a tilt actuator, to selectively shift and/or tilt port and/or starboard spuds 42, 44, if desired.

Some or all of the actuators of vessel 10 (e.g., the power source of cutter 20, ladder winch 26, port swing winch 36, starboard swing winch 38, starboard actuator 46, port actuator 48, the carriage actuator, and/or the tilt actuator) may be hydraulically powered. In particular one or more pumps (e.g., a Pump A, a Pump B, and a pilot pump—shown only in FIGS. 3-5) may be driven by one or more engines (not shown) to pressurize fluid. The pressurized fluid may then be directed through one or more valves to the different actuators (e.g., into motor and/or cylinder) and used to move the actuators (e.g., to rotate in a first direction and haul in cable, to rotate in a second direction and pay out cable, to extend, to retract, etc.). In the disclosed embodiment, the valves are commonly housed within one or more manifolds, which can be mounted to walls of platform 12 (e.g., to internal vertical surfaces of the walls). Conduits may extend between the pumps, the actuators, and the manifold(s) and, together with these components, make up a hydraulic system of vessel 10.

Figure 2:
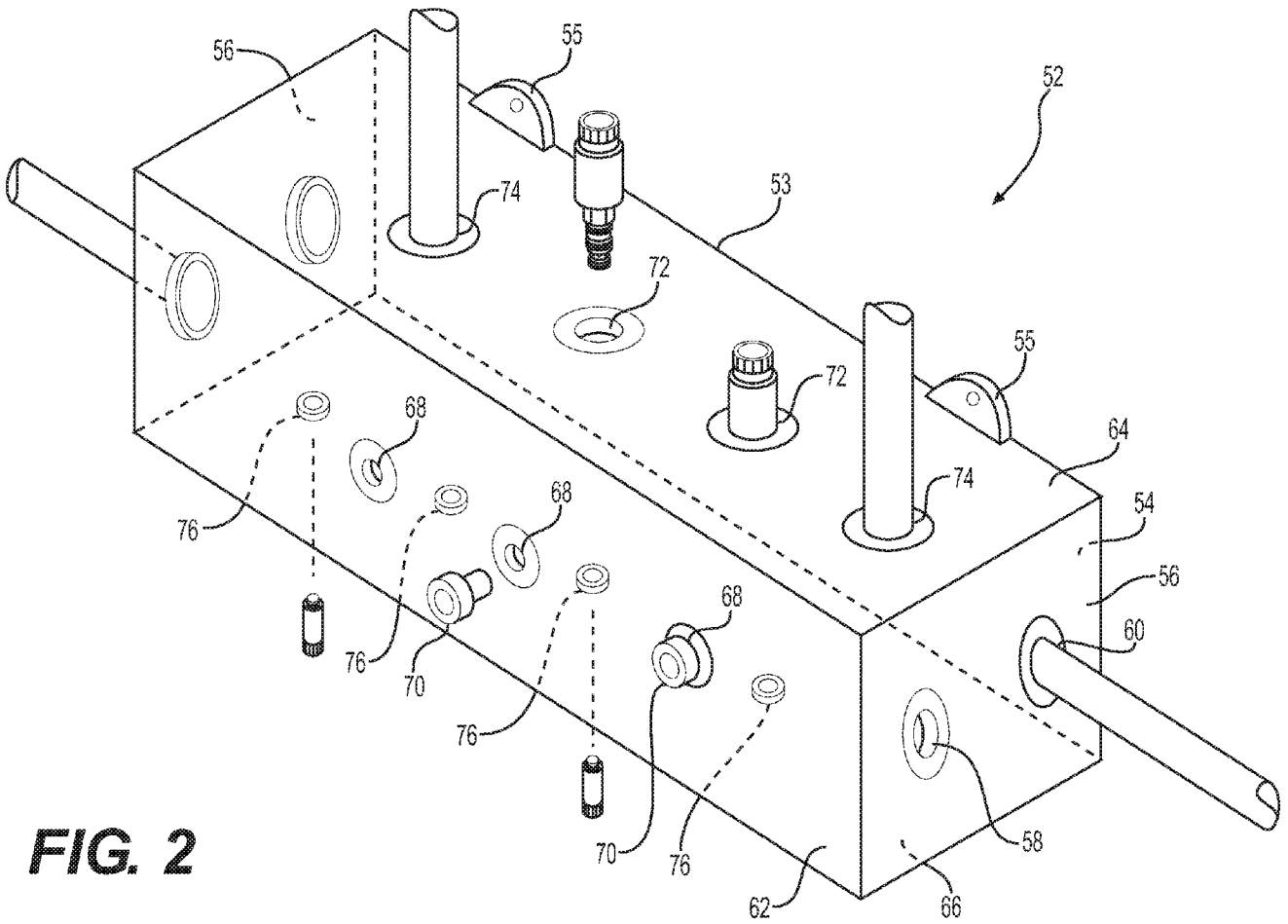
FIG. 2 is an exploded view isometric illustration of an exemplary manifold that may be used in conjunction with the dredge of FIG. 1.

An exemplary manifold 52 is illustrated in FIG. 2. As shown in this figure, manifold 52 may provide housing, internal passages, and mounting features for valves, pressure sensors, transducers, plugs, conduits, and other related hardware. In the disclosed embodiment, manifold 52 includes a generally cuboid (e.g., a rectangular parallelepiped) body 53 that is cast and/or machined as a monolithic structure from a non-corrosive material, for example from aluminum or stainless steel. Body 53 may have at least one external mounting surface 54 that has a generally vertical orientation (e.g., in general alignment with the pull of gravity) inside of platform 12 (referring to FIG. 1). External mounting surface 54 may include features (e.g., flanges, ears, tabs, hooks, bores, recesses, bosses, etc.) 55 that facilitate hanging of manifold 52 (and other connected components) on the internal vertical wall surface of platform 12.

Any or all of the remaining surfaces of body 53 may be formed to receive and/or connect to various hydraulic system components of vessel 10. For example, body 53 may include smaller opposing end surfaces 56, each of which may have any number of drain ports 58 and supply ports (e.g., high-pressure pump ports, pilot pump ports, accumulator ports, etc.) 60 formed therein. It is contemplated that ports 58, 60 may be formed within only one or both of end surfaces 56, as desired. In some embodiments (shown in FIGS. 3-5), internal drain and/or supply rails may extend from ports 58 and/or 60 at one end surface 56, completely through body 53, to ports 58 and/or 60 at an opposing end surface 56. The use of length-oriented drain and/or supply rails inside of body 53 may allow for multiple manifolds 52 to be connected end-to-end and share the drain and/or supply functionality between manifolds 52. This modular approach may make system modification and/or packaging clean, simple, and cost-effective.

Body 53 may also include a front surface 62 located opposite mounting surface 54, a top surface 64, and a bottom surface 66. Front surface 62 may be formed to include any number of different and spaced-apart pressure pickup ports 68. Ports 68 may have features (e.g., quick couplers, female threads, bosses, recesses, seals, etc.) that allow quick and/or temporary connection with other hydraulic components (e.g., measurement and/or sampling devices), and may extend to any internal passage (e.g., to the drain and/or supply rails) of manifold 52. When not in use, ports 68 may be closed off by way of plugs 70. The location of ports 68 on front surface 62 may allow for easy access (e.g., access not requiring bending under manifold 52 or use of a ladder or step stool) and, since permanent components may not generally be mounted to ports 68, component protection (e.g., protection from collision with personnel, tools, falling objects, etc.) may not be required at this location.

Top surface 64 may be formed to include any number of different and spaced-apart valve ports 72 and/or consumer ports 74. Ports 72 and/or 74 may each have features (e.g., bosses, recesses, threads, seals, etc.) that allow for longer-term connection with other hydraulic components (e.g., with valves, conduits, actuators, etc.), and may extend to any internal passage (e.g., to the drain and/or supply rails) of manifold 52. Ports 72 and/or 74 may be strategically located in top surface 64 to allow for direct connections (i.e. connections requiring reduced number of bends, elbows, curves, etc.) with the actuators of vessel 10 that are mounted to the deck of platform 12 (i.e., that are mounted above manifold 52). In addition, greater protection for the valves installed in ports 72 may be provided at a top of body 53 than at front surface 62. For example, the valves extending upward from body 53 may not be in a collision path with personnel or objects passing by manifold 52.

Bottom surface 66 may be formed to include any number of different and spaced-apart transducer ports 76. Ports 76 may each have features (e.g., bosses, recesses, threads, seals, etc.) that allow for longer-term connection with other hydraulic components (e.g., with sensors, transducers, etc.), and extend to any internal passage (e.g., to the drain and/or supply rails) of manifold 52. Ports 76 may be strategically located in bottom surface 66 to allow for direct connections with other electrical equipment (e.g., with controllers, ECMs, processors, etc.—not shown) of vessel 10 that are mounted inside of platform 12 (e.g., below manifold 52). In addition, an even greater amount of protection may be provided for the sensors and/or transducers installed in ports 76 at a bottom of body 53. For example, the sensors and/or transducers extending downward from body 53 may not be in a collision path with personnel or objects passing by manifold 52 or in a collision path with anything falling onto manifold 52. This greater amount of protection may be advantageous due to the more delicate nature of the sensors and/or transducers, as compared to the other hydraulic system components.

Figure 3:
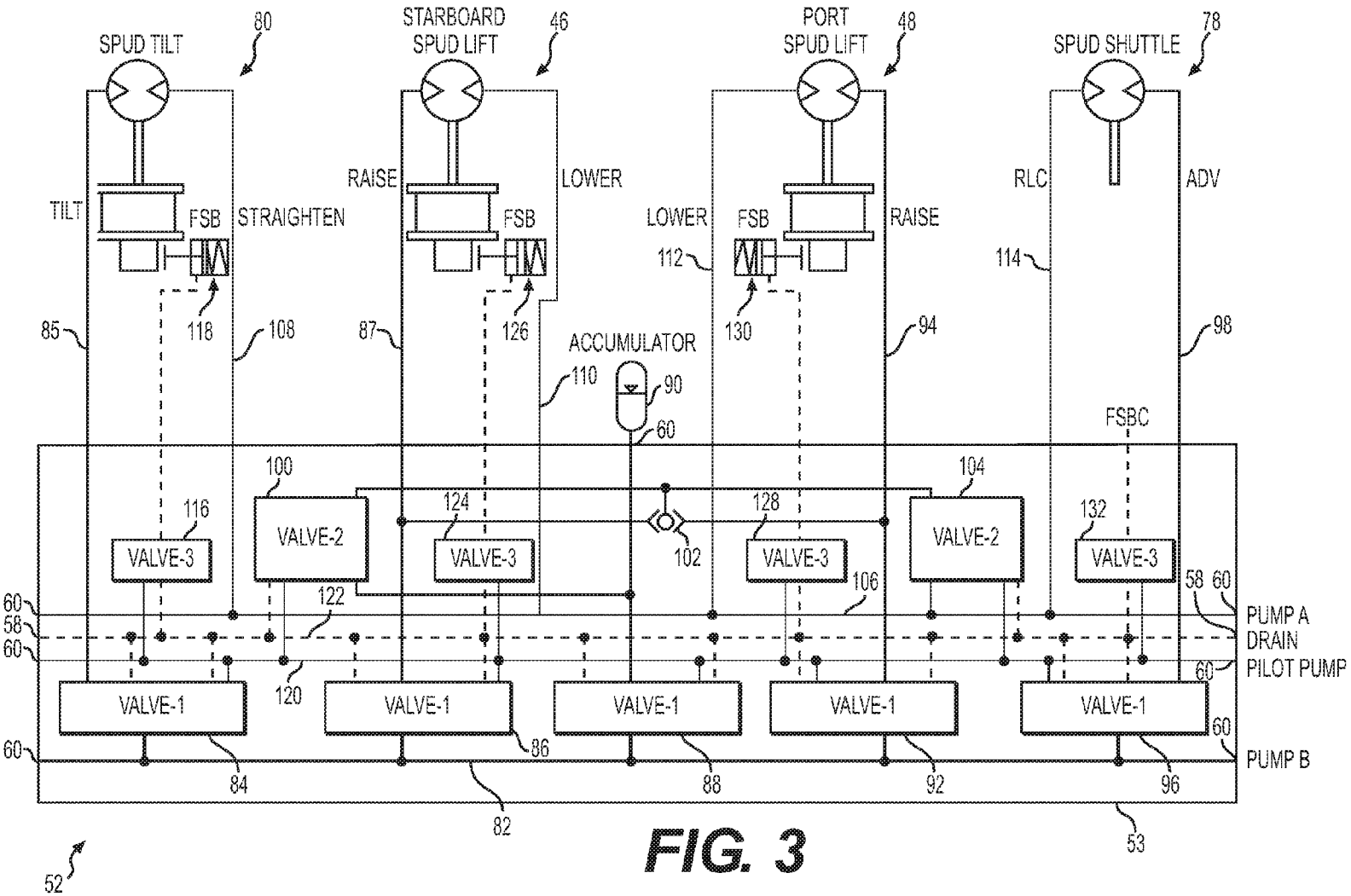
FIGS. 3, 4, and 5 are schematic illustrations of exemplary variations of the manifold of FIG. 2.
Figure 4:
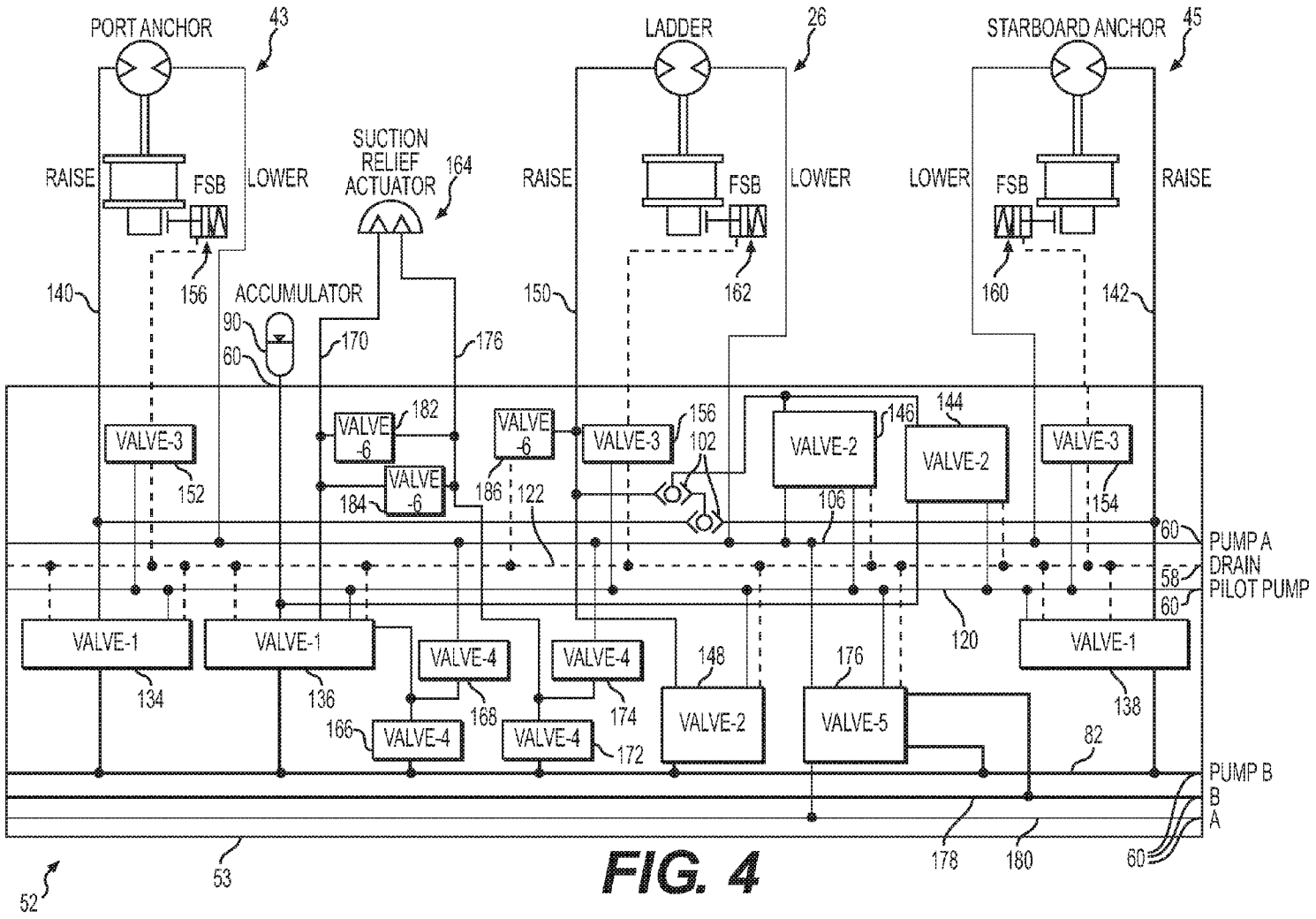
Figure 5:
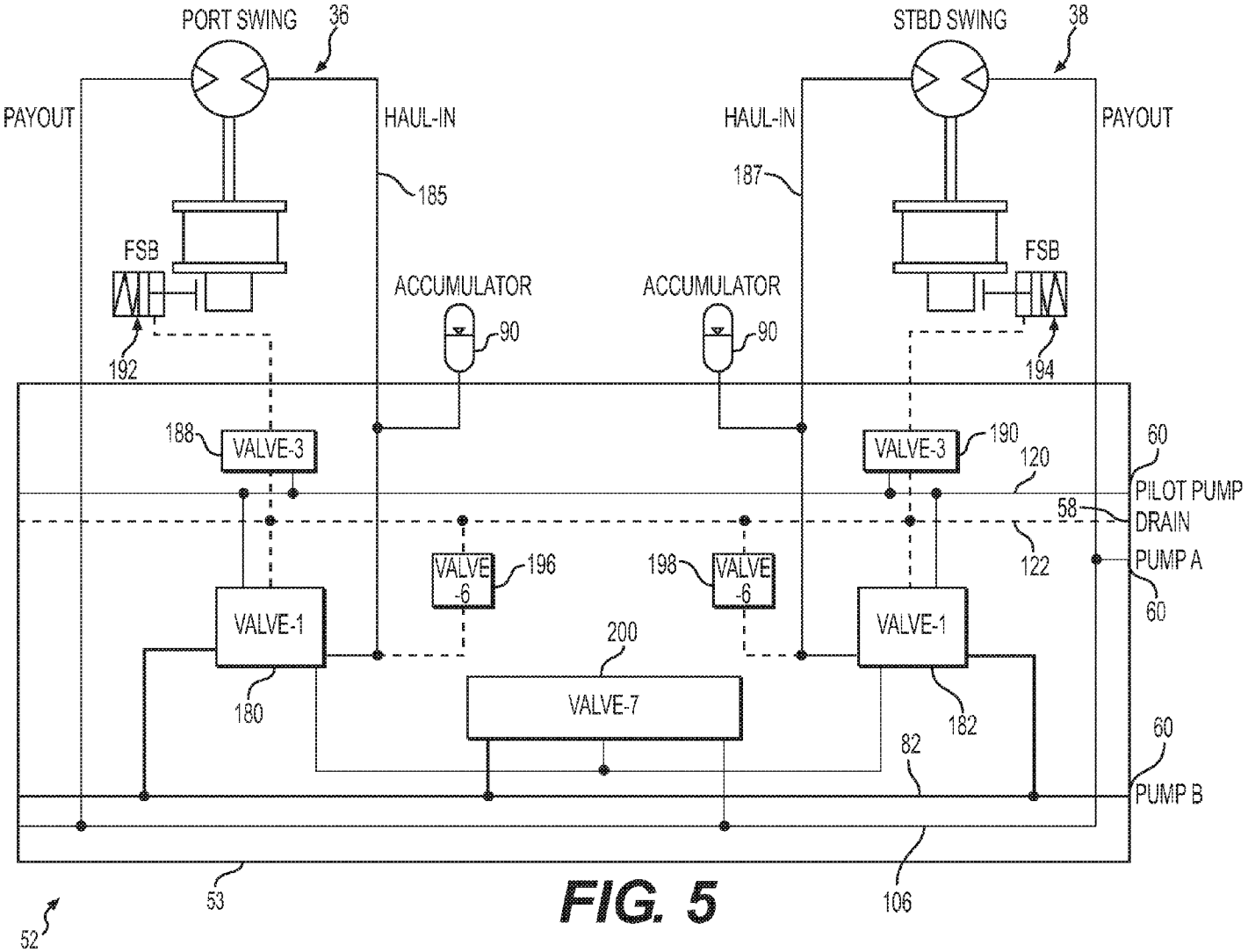

FIGS. 3-5 schematically illustrate three different exemplary embodiments of manifold 52. Manifold 52 of FIG. 3 may be used in conjunction with starboard and port spud actuators 46, 48, a spud carriage actuator 78, and a spud tilt actuator 80. Manifold 52 of FIG. 4 may be used in conjunction with ladder winch 26, and port and starboard anchor winches 43, 45. Manifold 52 of FIG. 5 may be used in conjunction with port and starboard swing winches 36, 38.

As shown in FIG. 3, a plurality of valves may be mounted to body 53 of manifold 52 and used to selectively connect at least one drain port 58, a plurality of supply ports 60, starboard spud actuator 46, port spud actuator 48, spud carriage actuator 78, and spud tilt actuator 80 with each other. In the disclosed embodiment, a limited number of different valves may be utilized within manifold 52, so as to increase part count and thereby reduce assembly complexity and cost. Specifically, manifold 52 of FIG. 3 primarily includes three different types of valves labeled as Valve-1, Valve-2, and Valve-3. Each of these types of valves may be cartridge-style valves received within body 53 via different ports 72 in top surface 64.

Figure 6:
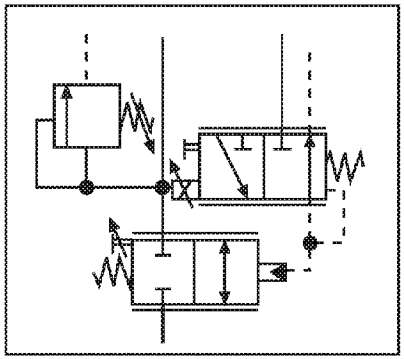
FIGS. 6-12 are schematic illustrations of exemplary valves that may be used in conjunction with the manifolds of FIGS. 2-5.

As shown in FIG. 6, Valve-1 may be a post-compensated, electrohydraulic (EH) valve that is pilot-opened based on an electrical command signal. As used in the embodiment of FIG. 3, each valve of the Valve-1 type may be controlled to regulate a flow of high-pressure fluid from a first pump labeled as Pump B (i.e., high-pressure fluid from a common supply rail 82 in communication with port 60 of pump B) to an associated consumer. For example, a first valve 84 of the Valve-1 type may be used to selectively direct the high-pressure fluid into a tilt passage 85 of spud tilt actuator 80. As a greater amount of the high-pressure fluid is allowed to pass through first valve 84, the spud carriage (and any associated spud) may be caused to tilt by a greater amount. A second valve 86 of the Valve-1 type may be used to selectively direct high-pressure fluid into a raise passage 87 of starboard spud actuator 46. As a greater amount of the high-pressure fluid is allowed to pass through second valve 86, starboard spud 44 (referring to FIG. 1) may be raised by a greater amount. A third valve 88 of the Valve-1 type may be used to selectively direct high-pressure fluid into an accumulator 90 and/or from accumulator 90 into common supply rail 82, depending on a pressure differential between accumulator 90 and common supply rail 82. The fluid stored within accumulator 90 may be used during a peak-shaving and/or energy-recuperation event, when a fluid pressure and/or flow rate of pressurized fluid in common supply rail 82 or another consumer is low. A fourth valve 92 of the Valve-1 type may be used to selectively direct high-pressure fluid into a raise passage 94 of port spud actuator 48. As a greater amount of the high-pressure fluid is allowed to pass through fourth valve 92, port spud 42 (referring to FIG. 1) may be raised by a greater amount. A fifth valve 96 of the Valve-1 type may be used to selectively direct high-pressure fluid into an advance passage 98 of spud carriage actuator 78. As a greater amount of the high-pressure fluid is allowed to pass through fifth valve 96, the spud carriage may be moved by a greater amount in a first direction.

Figure 7:
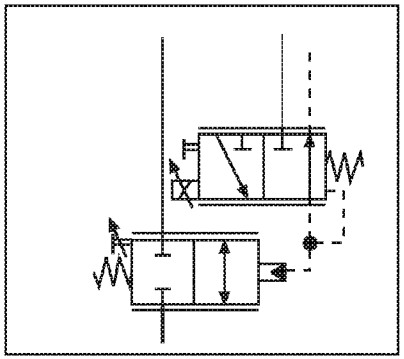

As shown in FIG. 7, Valve-2 may be a non-compensated, electrohydraulic (EH) valve that is pilot-opened based on an electrical command signal. As used in the embodiment of FIG. 3, Valve-2 may be controlled to regulate fluid flows into and out of accumulator 90. For example, a first valve 100 of the Valve-2 type may be used to selectively direct high-pressure fluid discharging from raise passage 87 or from raise passage 94 (e.g., during spud lowering) into accumulator 90. A resolver 102 may be used to allow discharging fluid to flow into accumulator 90 from whichever of raise passages 87 or 94 has the higher pressure. It should be noted that only one of port and starboard spuds 42, 44 may generally be lowered at a time. Accordingly, only one of raise passages 87, 94 should generally be pressurized at a time, and that passage may be connected to accumulator 90 via resolver 102 and first valve 100. A second valve 104 of the Valve-2 type may be used to selectively direct high-pressure fluid from accumulator 90 into a supply common rail 106 that is in communication with a straighten passage 108 of spud tilt actuator 80, a lower passage 110 of port spud actuator 46, a lower passage 112 of starboard spud actuator 48, a relocate passage 114 of spud carriage actuator 78, and/or a second pump labeled as Pump A.

Figure 8:
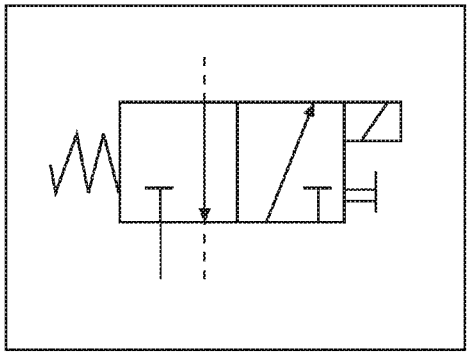

As shown in FIG. 8, Valve-3 may be an electromechanical valve that is directly actuated based on an electrical command signal. As used in the embodiment of FIG. 3, Valve-3 may be controlled to regulate an associated fail-safe-brake (fsb). For example, Valve-3 may be energized to hold open the associated fsb during operation, only allowing the fsb to close and thereby block motion of the associated component during a loss of electrical power. For example, a first valve 116 of the Valve-3 type may be used to regulate a first fsb 118 associated with spud tilt actuator 80. As long as electrical power is supplied to first valve 116, first valve 116 may direct a flow of pilot fluid from a common supply rail 120 (i.e., a common rail that is in communication with port 60 of a Pilot Pump) into first fsb 118 holding first fsb 118 open. Upon loss of electrical power to first valve 116, first valve 116 may move to connect first fsb 118 with a common drain rail 122 (i.e., a common rail that is communication with a drain port 58), thereby allowing first fsb 118 to close and inhibit spud tilt actuator 80 from moving. A similar second valve 124 of the Valve-3 type may be associated with starboard spud actuator 46 and function in a similar manner to regulate operation of a second fsb 126. A third valve 128 of the Valve-3 type may be associated with port spud actuator 48 and function in a similar manner to regulate operation of a third fsb 130. Although not used in the embodiment of FIG. 3, a fourth valve 132 of the Valve-3 type may be provided inside manifold body 53. It is contemplated that fourth valve 132 could be associated with spud carriage actuator 70 (or another component of vessel 10) and function in a similar manner to regulate operation of a fourth fsb (not shown).

As shown in the embodiment of FIG. 4, a plurality of valves may be mounted to body 53 of manifold 52 and used to selectively connect drain port 58, supply ports 60, port anchor winch 43, starboard anchor winch 45, and ladder winch 26 with each other. Like the embodiment of FIG. 3, manifold 52 of FIG. 4 may include a limited number of different valves so as to increase part count and thereby reduce assembly complexity and cost. For example, manifold 52 of FIG. 4 may use valves of the Valve-1 type, the Valve-2 type, and the Valve-3 type in the same manner described above, with respect to FIG. 3. That is, manifold 52 of FIG. 4 may include first, second, and third valves 134, 136, and 138 of the Valve-1 type in association with a raise passage 140 of port anchor winch 43, accumulator 90, and a raise passage 142 of starboard anchor winch 45, respectively. In addition, manifold 52 of FIG. 4 may include first, second, and third valves 144, 146, and 148 of the Valve-2 type in association with accumulator 90 (just like first valve 100 of FIG. 3), common supply rail 106 (just like second valve 104 of FIG. 3), and a raise passage 150 of ladder winch 26. Third valve 148 may function similar to first and third valves 134 and 138, but in association with raising of ladder 14 without pressure compensation. Manifold 52 of FIG. 4 may further include first, second, and third valves 152, 154, and 156 of the Valve-3 type in association with first, second, and third fsbs 158, 160, and 162 of port anchor, starboard anchor, and ladder winches 43, 45, and 26, respectively. Manifold 52 of FIG. 4 may also include two resolvers 102 that together function to allow discharging fluid to flow into accumulator 90 from whichever of raise passages 140, 142, or 150 has the higher pressure.

Figure 9:
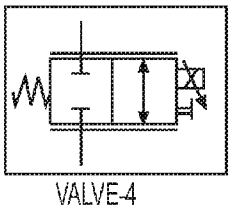

Manifold 52 of the FIG. 4 embodiment may include additional valves (each labeled as Valve-4), which have not yet been discussed. As shown in FIG. 9, Valve-4 may be an on-off (i.e., flow-passing or flow-blocking) electromechanical valve that can be directly actuated based on an electrical command signal. As used in the embodiment of FIG. 4, each Valve-4 may be controlled to selectively connect one of common supply rail 82 or 106 with a common suction relief actuator 164. In particular, a first valve 166 and a second valve 168 may be used to selectively connect common supply rails 82 and 106 to a first passage 170 of suction relief actuator 164, respectively; while a third valve 172 and a fourth valve 174 may be used to selectively connect common supply rails 82 and 106 to a second passage 176 of suction relief actuator 164.

Figure 10:
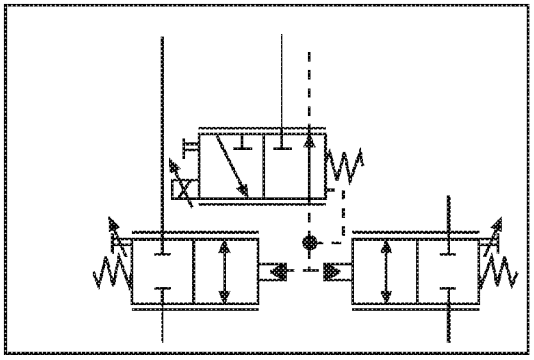

Manifold 52 may further include a type of valve (labeled as Valve-5) that closely resembles Valve-2. As shown in FIG. 10, Valve-5 may also be a non-compensated, electrohydraulic (EH) valve that is pilot-opened based on an electrical command signal. As used in the embodiment of FIG. 4, a single valve 176 of the Valve-5 type may be controlled to regulate two different fluid flows from two different pumps (i.e., from Pump A via common supply rail 106, and from Pump B via common supply rail 82) into two auxiliary rails 178 and 180. Although not utilized within manifold 52 of FIG. 4, the fluid from auxiliary rails 178 and/or 180 may be selectively passed to other manifolds 52 and used to supplement flows of pressurized fluid available in those manifolds 52.

Figure 11:
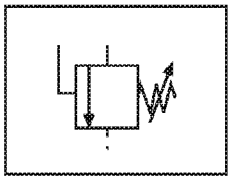

Manifold 52 may also include a plurality of pressure relief valves (each labeled as Valve-6). As shown in FIG. 11, Valve-6 may be used to selectively pass pressurized fluid from a higher-pressure passage to a lower-pressure passage after a pressure differential between the passages exceeds a threshold of the valve (e.g., as set by a biasing spring). In particular, first and second valves 182 and 184 of the Valve-6 type may be situated to selectively relieve fluid from first passage 170 of suction relief actuator 164 into second passage 176, and from second passage 176 into first passage 170, respectively. A third valve 186 of the Valve-6 type may be situated to selectively relieve fluid from raise passage 150 of ladder winch 26 into common drain rail 122.

As shown in the embodiment of FIG. 5, a plurality of valves may be mounted to body 53 of manifold 52 and used to selectively connect drain port 58, supply ports 60, port swing winch 36, and starboard swing winch 38 with each other. Like the embodiment of FIG. 4, manifold 52 of FIG. 5 may include a limited number of different valves so as to increase part count and thereby reduce assembly complexity and cost. In fact, manifold 52 of FIG. 5 may use valves of the Valve-1 type, the Valve-3 type, and the Valve-6 type in the same manner described above, with respect to FIG. 4. That is, manifold 52 of FIG. 5 may include a first valve 180 and a second valve 182 of the Valve-1 type in association with a haul-in passage 185 of port swing winch 36, and a haul-in passage 187 of starboard swing winch 38, respectively. Manifold 52 of FIG. 5 may further include first and second valves 188 and 190 of the Valve-3 type in association with first and second fsbs 192 and 194 of port and starboard swing winches 36 and 38, respectively; and first and second valves 196 and 198 of the Valve-6 type in association with haul-in passages 185 and 187, respectively.

Figure 12:
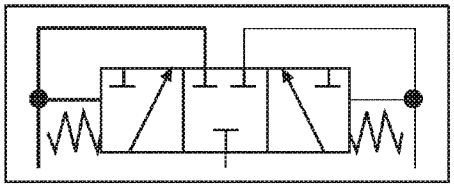

Manifold 52 of the FIG. 5 embodiment may include an additional valve (labeled as Valve-7) 200, which has not yet been discussed. As shown in FIG. 12, Valve-7 may be a pilot operated selector valve that moves to connect a lower-pressure one of supply rails 82 and 106 with haul-in passages 185 and/or 187. As used in the embodiment of FIG. 4, valve 200 may be used to selectively pass highly-pressurized fluid discharging from one or both of haul-in passages 185 and/or 187 into the lower-pressure one of supply rails 82 and 106, thereby supplementing flow in the rails.

Dual accumulators 90 are shown as being associated with manifold 52 of the FIG. 5 embodiment. Specifically, one accumulator 90 is fluidly connected with each of haul-in passages 185 and 187 by way of manifold 52. It is contemplated that a single accumulator 90 could be used in place of the dual accumulators 90, if desired.

INDUSTRIAL APPLICABILITY

The disclosed manifolds may be used in any dredge application where simplicity, durability, performance, and cost are important. The disclosed manifolds may provide simplicity by co-locating common hydraulic components in a compact configuration that utilizes shared mounting, fluid supply, and fluid drain functionality. Durability may be provided via the robust design of the disclosed manifolds, the location of particular components within particular faces of the disclosed manifolds, and the protection provided to these components due to their location. Performance may be improved due to the orientation and close-packaging of interrelated components. Cost of the disclosed manifolds may be low due to the repeated use of common components and reduced assembly difficulty.

In addition, the disclosed manifolds may be modular, allowing for ease of modification and/or expansion. For example, the disclosed manifolds may be mounted separately (e.g., to different walls within platform 12) or together (e.g., connected end-to-end). When connected end-to-end, the use of common supply and drain rails within the disclosed manifolds may help to reduce external plumbing requirements. In addition, basic functionality (e.g., fsb use—see FIG. 3 in connection with spud carriage actuator 70) may be provided within each manifold, regardless of application requirements, allowing for selective use and/or future need of the functionality.

It will be apparent to those skilled in the art that various modifications and variations can be made to the disclosed manifold and dredge. Other embodiments will be apparent to those skilled in the art from consideration of the specification and practice of the disclosed manifold and dredge. It is intended that the specification and examples be considered as exemplary only, with a true scope being indicated by the following claims and their equivalents.

What is claimed is:

1. A hydraulic manifold for use with a dredge, comprising:

a body having a mounting surface, a front surface located opposite the mounting surface, a top surface located between the mounting and front surfaces, a bottom surface located opposite the top surface, and end surfaces located opposite each other and connecting the mounting, front, top, and bottom surfaces;

at least one drain port and at least one supply port in at least one of the end surfaces;

at least one valve port in the top surface;

at least one consumer port in the top surface; and at least one transponder port in the bottom surface wherein:

the at least one valve port includes a plurality of valve ports;

the at least one transponder port includes a plurality of transponder ports; and the at least one consumer port includes a plurality of consumer ports.

2. The hydraulic manifold of claim 1, wherein all valve ports of the hydraulic manifold are in the top surface.

3. The hydraulic manifold of claim 1, wherein all transponder ports of the hydraulic manifold are in the bottom surface.

4. The hydraulic manifold of claim 1, wherein all consumer ports of the hydraulic manifold are in the top surface.

5. A hydraulic manifold for use with a dredge, comprising:

a body having a mounting surface, a front surface located opposite the mounting surface, a top surface located between the mounting and front surfaces, a bottom surface located opposite the top surface, and end surfaces located opposite each other and connecting the mounting, front, top, and bottom surfaces;

at least one drain port and at least one supply port in at least one of the end surfaces;

at least one valve port in the top surface;

at least one consumer port in the top surface; and at least one transponder port in the bottom surface wherein:

the at least one supply port includes at least a first supply port in a first of the end surfaces, and at least a second supply port in a second of the end surfaces; and the hydraulic manifold further includes a common supply rail connecting the at least a first and the at least a second supply ports.

6. The hydraulic manifold of claim 5, wherein:

the common supply rail is a first common supply rail connected to receive pressurized fluid from a first pump;

the at least one supply port further includes at least a third supply port in the first of the end surfaces, and at least a fourth supply port in the second of the end surfaces; and the hydraulic manifold further includes a second common supply rail connecting the at least a third and the at least a fourth supply ports, the second common supply rail connected to receive pressurized fluid from a second pump.

7. The hydraulic manifold of claim 6, wherein:

the at least one drain port includes at least a first drain port in the first of the end surfaces, and at least a second drain port in the second of the end surfaces; and the hydraulic manifold further includes a common drain rail connecting the at least a first and the at least a second drain ports.

8. The hydraulic manifold of claim 5, further including:

at least one auxiliary supply rail inside the body and extending to an auxiliary port formed within at least one of the end surfaces; and at least one electrohydraulic valve in the at least one valve port and configured to selectively direct fluid from the common supply rail to the at least one auxiliary supply rail.

9. The hydraulic manifold of claim 5, further including:

a first pilot port in the first of the end surfaces, and a second pilot port in the second of the end surfaces; and a common pilot rail extending between the end surfaces and fluidly connected to the first and second pilot ports, the common pilot rail being configured to receive fluid from a pilot pump.

10. The hydraulic manifold of claim 5, further including at least one actuator valve in the at least one valve port and configured to regulate fluid flows between the at least one supply port, the at least one drain port, and at least one of a swing winch, a ladder winch, and a spud actuator.

11. The hydraulic manifold of claim 10, wherein the at least one valve is an electrohydraulic valve.

12. The hydraulic manifold of claim 11, wherein the electrohydraulic valve is post-compensated.

13. The hydraulic manifold of claim 5, further including at least one electromechanical valve in the at least one valve port and configured to fluidly connect the at least one supply port, the at least one drain port, and a fail-safe-brake.

14. The hydraulic manifold of claim 5, further including at least one electrohydraulic valve in the at least one valve port and configured to fluidly connect a winch and an accumulator.

15. The hydraulic manifold of claim 14, wherein the at least one supply port is connected to receive fluid from the accumulator.

16. The hydraulic manifold of claim 14, wherein:

the winch is a first winch;

the at least one valve port includes:

a first valve port; and a second valve port; and the at least one electrohydraulic valve includes:

a first electrohydraulic valve in the first valve port and configured to fluidly connect the first winch and the accumulator; and a second electrohydraulic valve in the second valve port and configured to fluidly connect a second winch and the accumulator.

17. The hydraulic manifold of claim 16, further including at least one resolver connecting a higher pressure haul-in passage of the first and second winches to the accumulator.

18. The hydraulic manifold of claim 17, wherein:

the at least one supply port includes:

a first supply port configured to fluidly connect with a first pump; and a second supply port fluid configured to fluidly connect with a second pump;

the at least one valve port further includes a third valve port; and the hydraulic manifold further includes a hydraulically actuated selector valve in the third valve port and configured to selectively connect at least one of the haul-in passage of the first winch, the haul-in passage of the second winch, and the accumulator to a lower pressure one of the first and second supply ports.

19. The hydraulic manifold of claim 5, further including at least one electromechanical valve in the at least one valve port and configured to selectively connect other components of the hydraulic manifold to a suction relief actuator.

20. The hydraulic manifold of claim 5, further including at least one pressure pickup port in the front surface.

21. The hydraulic manifold of claim 5, wherein:

the body has a substantially cuboid shape; and the mounting, front, top, and bottom surfaces are substantially rectangular, larger than the end surfaces, and have lengths extending between the end surfaces.

22. A hydraulic manifold, comprising:

a body having a mounting surface, a front surface located opposite the mounting surface, a top surface located between the mounting and front surfaces, a bottom surface located opposite the top surface, and end surfaces located opposite each other and connecting the mounting, front, top, and bottom surfaces;

a drain port and a plurality of supply ports in each of the end surfaces;

a common drain rail extending between the end surfaces and fluidly connected to the drain ports;

first and second common supply rails extending between the end surfaces and fluidly connected to opposing pairs of the plurality of supply ports, the first and second common supply rails being configured to separately receive fluid from first and second pumps;

a common pilot rail extending between the end surfaces and fluidly connected to opposing pairs of the plurality of supply ports, the common pilot rail being configured to separately receive fluid from a pilot pump;

a plurality of valve ports in the top surface;

a plurality of consumer ports in the top surface;

a plurality of transponder ports in the bottom surface;

a plurality of pressure pickup port in the front surface;

a plurality of actuator valves in the plurality of valve ports and configured to regulate fluid flows between the first common supply rail, the second common supply rail, the common drain rail, and at least one of a swing winch, a ladder winch, and a spud actuator; and at least one electromechanical valve in one of the plurality of valve ports and configured to fluidly connect the at least one supply port, the at least one drain port, and a fail-safe-brake.

23. The hydraulic manifold of claim 22, further including at least one electrohydraulic valve in one of the plurality of valve ports configured to fluidly connect an accumulator to at least one of the swing winch, ladder winch, and spud actuator.

24. The hydraulic manifold of claim 23, wherein at least one of the first common supply rail, second common supply rail, and common pilot rail is connected to receive fluid from the accumulator.

25. The hydraulic manifold of claim 23, further including at least one electromechanical valve in the at least one valve port and configured to selectively connect other components of the hydraulic manifold to a suction relief actuator.

26. The hydraulic manifold of claim 22, wherein:

the body has a substantially cuboid shape; and the mounting, front, top, and bottom surfaces are substantially rectangular, larger than the end surfaces, and have lengths extending between the end surfaces.

* * * * *